United States Patent [19]

Means et al.

[11] Patent Number: 5,052,654

[45] Date of Patent: Oct. 1, 1991

[54] MOLDED PLASTIC VOID HOLD DOWN DEVICE FOR CONCRETE BEAM-SLAB FORMATION

[76] Inventors: Michael J. Means, 1041 Birch Creek Dr., Wilmington, N.C. 28403; Donald B. Coogan, Sand Pebbles B-1 Hwy 421 S., Carolina Beach, N.C. 28424

[21] Appl. No.: 505,670

[22] Filed: Apr. 6, 1990

[51] Int. Cl.[5] ..... E04G 13/04; E04G 17/00

[52] U.S. Cl. ..... 249/50; 248/74.3; 249/91; 249/149; 249/177; 249/207; 249/219.1

[58] Field of Search ..... 249/50, 91, 93, 149, 249/177, 207, 219.1; 248/59, 74.3, 74.4

[56] References Cited

U.S. PATENT DOCUMENTS

| | | | |
|---|---|---|---|
| 826,161 | 7/1906 | Hayden | 248/59 |
| 1,758,040 | 5/1930 | Hess | 248/59 |
| 2,161,782 | 6/1939 | Flower | 248/59 |
| 2,949,657 | 8/1960 | Anson | 249/65 |
| 3,228,679 | 1/1966 | Dees | 249/3 |
| 3,273,837 | 9/1966 | Willert et al. | 248/59 |
| 3,301,249 | 1/1967 | Hendricks | 249/91 |
| 3,506,227 | 4/1970 | Jenkins | 248/59 |
| 3,523,668 | 8/1970 | Logsdon | 248/74.3 |
| 4,768,741 | 9/1988 | Logsdon | 248/74.3 |

FOREIGN PATENT DOCUMENTS

| | | | |
|---|---|---|---|
| 3044246 | 6/1982 | Fed. Rep. of Germany | 248/59 |

*Primary Examiner*—James C. Housel

*Attorney, Agent, or Firm*—Rhodes, Coats & Bennett

[57] ABSTRACT

The invention is a molded plastic void hold down device utilized in concrete beams to restrict and hold down the vertical and lateral movement of voids placed within the concrete beam during construction. In particular, the hold down device comprises a molded plastic structure that includes a lower flange that extends over a top portion of the void, a coupling sleeve integrally formed with the lower flange and extending upwardly therefrom for frictionally coupling to the lower end portion of a down rod, and a web integrally formed with both the coupling sleeve and the lower flange and extending outwardly from opposite sides of the coupling sleeve.

12 Claims, 2 Drawing Sheets

MOLDED PLASTIC VOID HOLD DOWN DEVICE FOR CONCRETE BEAM-SLAB FORMATION

FIELD OF THE INVENTION

The present invention relates to concrete beam formations, and more particularly to void hold down devices used in a concrete beam to engage and hold down voids placed in the beam during the concrete beam formation process.

BACKGROUND OF THE INVENTION

For many years, it has been known and also been a practice to place voids, particularly cardboard and styrofoam voids, in concrete beams during the formation process. Voids in a concrete beam make the beam lighter without any decrease in effective strength, and are overall very cost effective inasmuch as the presence of such voids decrease concrete and reinforcing steel requirements.

In forming a concrete beam with a void, it is necessary to strategically place the void within the overall beam structure. This is customarily accomplished by employing a void hold down device within the beam structure itself. Once concrete is poured within the form structure, the voids will tend to rise. Therefore, it is important that the void hold down devices be particularly positioned above the voids so as to appropriately limit the vertical rising movement of the voids during casting.

It is known in the prior art to utilize an open wire steel-type void hold down device. The wire steel hold down device is shaped so as to surround an upper portion of the void and includes an open top band structure. The wire steel hold down device includes a central coupling section that extends upwardly from the base or band and engages the void. This coupling section is formed of wire steel itself and is threaded so as to receive the lower end portion of a hold down rod that is adjustably supported about an overhead structure that extends across and over the concrete form. There are numerous disadvantages and drawbacks to these wire steel void hold down devices. First, they are relatively expensive. Secondly, because all voids are a source of oxygen and moisture, there is natural tendency for corrosion of any ferrous material in permanent contact. Internal corrosion can lead to future durability failure. Additionally, because of the nature of the wire steel, these types of void hold down devices tend to corrode easily and this makes it difficult to extract the hold down rod from these devices once the concrete beam has been cured. In this same regard, the structure that joins the hold down device is formed by spirals of wire and because of that is somewhat open to concrete passing through such structure and becoming embedded in and around the hold down rod. This also makes it more difficult for the hold down rod to be extracted from the wire steel hold down device.

Another drawback to the wire steel type hold down device is that its sleeve coupling that attaches to a down rod is completely open through the bottom. This enables the wire steel hold down device to be threaded up the down rod leaving the lower end of the down rod exposed. The problem presented here is that it is very easy for the wire steel hold down devices to be incorrectly spaced on the down rods resulting in the voids being mispositioned within the beam structure. In particular, it is possible for the wire steel hold down device to assume a position midway the down rod and for the underlying void to be pierced by the lower end of the down rod and to assume an improper final position within the concrete beam.

In addition, the wire steel hold down devices are difficult to use and often time consuming to install. Such wire steel hold down devices are not very versatile in as much as different sizes are required for different size voids, and because of the nature of the wire steel hold down devices they are not readily available in different sizes.

Therefore, there is and continues to be a need for a cost effective, non-corrosive and easy to use void hold down device.

SUMMARY AND OBJECTS OF THE INVENTION

The present invention entails a molded plastic void hold down device that is designed to overcome the disadvantages and drawbacks of prior void hold down devices. The present molded plastic hold down deivce includes a lower flange that is integrally formed with a coupling sleeve that is designed to frictionally engage and fit the lower end of a down rod. In addition, the molded plastic hold down device includes an integral web structure that connects and joins both the lower flange and the coupling sleeve. In use, a down rod from an overhead frame structure is frictionally engaged within the coupling sleeve and acts to hold or suspend the molded plastic void hold down device within the beam form. Once the beam has been formed and the concrete has hardened, the down rod can simply be frictionally disengaged from the sleeve coupling.

It is therefore an object of the present invention to provide a void hold down device that is cost effective.

Another object of the present invention resides in the provision of a void hold down device that is constructed of molded plastic and which can be easily and conveniently made in different sizes to mate with the various void shapes encountered.

A further object of the present invention is to provide a void hold down device of the character referred to above that resists corrosion.

Another object of the present invention resides in the provision of a void hold down device of the character referred to above that is designed to facilitate the removal of a down rod from the same once the concrete beam has been formed and the void hold down device is encased within the concrete.

It is also an object of the present invention to provide a molded plastic void hold down device that includes a coupling sleeve that includes a closed surrounding wall structure that prevents concrete from seeping into the internal areas within the coupling sleeve and bonding to the lower end portion of the down rod frictionally held therein.

Another object of the present invention resides in the provision of a void hold down device used in concrete beam structures that is easy to use and which can be appropriately erected in a concrete form quickly and easily.

A further object of the present invention is to provide a void hold down device that is designed to fix the position of the void at an appropriate height within the concrete beam structure.

It is also an object of the present invention to provide a void hold down device wherein the coupling sleeve is closed about the lower end so as to prevent the down rod from extending therethrough thereby assuring that the hold down device assumes a generally constant position on the down rod.

Other objects and advantages of the present invention will become apparent and obvious from a study of the following description and the accompanying drawings which are merely illustrative of such invention.

DESCRIPTION OF THE INVENTION

With further reference to the drawings, the void hold down device is shown therein and indicated generally by the numeral 36. Before describing the hold down device 36 in detail, it will be beneficial to basically review the structure of a concrete form, voids used in concrete forms, and a conventional frame structure utilized to support void hold down devices.

Figure 1:
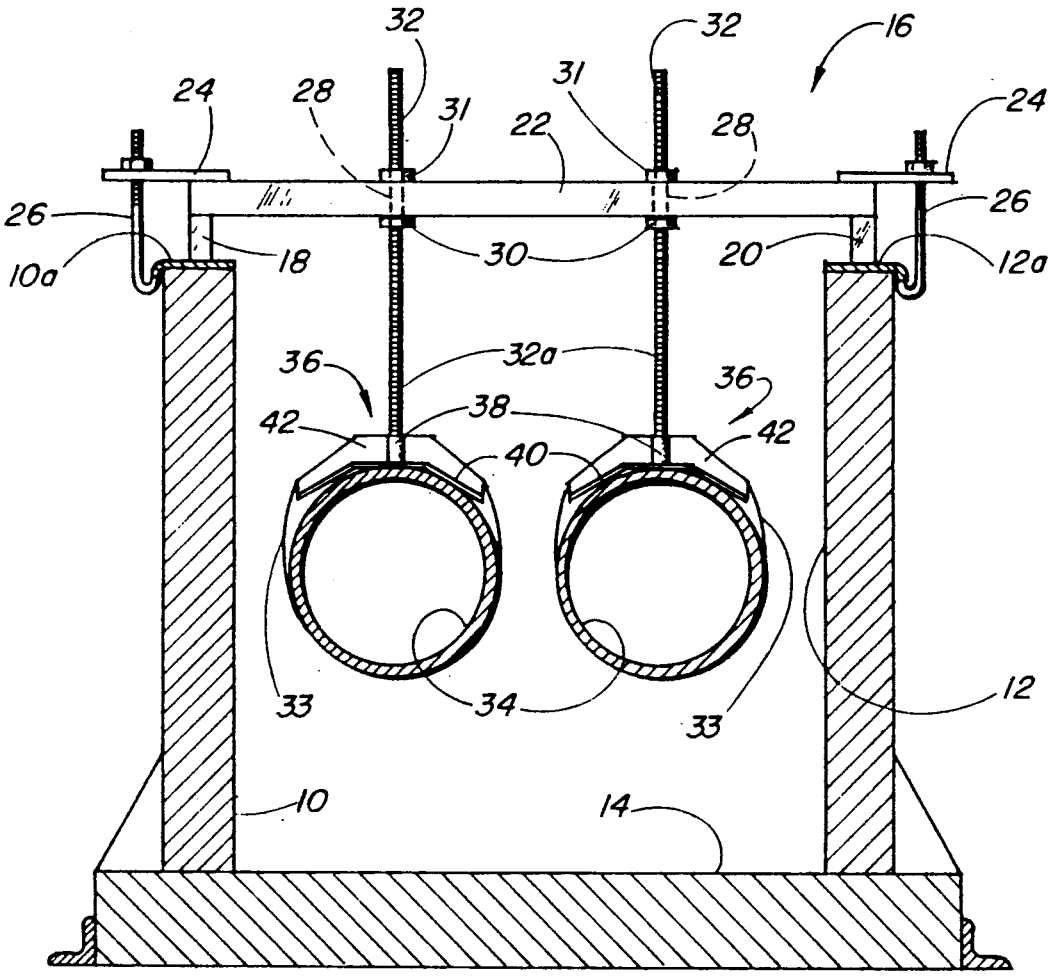
FIG. 1 is a cross-sectional view of a beam forming structure and illustrates the void hold down devices being secured to and disposed over voids prior to concrete being poured into the beam forming structure.

In this regard, attention is first directed to a conventional concrete beam form. In FIG. 1, a concrete beam form is shown therein and includes a pair of sides 10 and 12 and a bottom 14. Each side includes a screed shelf 10*a*, 12*a* that extends outwardly from the top edge of each side. Typically, such a concrete form would be elongated so as to produce an elongated concrete beam.

It is conventional to utilize voids within a concrete beam. The presence of voids within the concrete beam obviously make the beam lighter without decreasing the effective strength of the beam and also contribute to reducing the total cost of not only the concrete beam but also its support sub-structure. In FIG. 1, there is shown a pair of cardboard voids 34 disposed within the concrete form and because FIG. 1 illustrates a concrete form prior to the concrete being poured therein, the voids assuming a position spaced from the bottom 14 and tied to the hold down device 36.

To particularly position the respective voids 34 within the concrete form and to limit their vertical movement, it is conventional practice to provide an overhead frame structure that extends across the top of the concrete form to assist in engaging and holding down the voids 34. As seen in FIG. 1, there is shown a cross frame structure, indicated generally by the numeral 16, that spans and extends over the top of the concrete form. Viewing the cross frame structure 16 in more detail, it is seen that the same includes a pair of stub legs 18 and 20 that rest on the pair of horizontal screed shelves 10*a* and 12*a* that extend outwardly from the respective sides 10 and 12 of the concrete form. Connecting the stub legs 18 and 20 is a cross member 22. A pair of ears 24 project outwardly from each end of the cross member 22 and connect to a downwardly extending stabilizing J-bolt 26 that is hooked and anchored to the underside of a respective shelf 10*a* or 12*a*.

A pair of vertical openings 28 is provided in the cross member 22 and secured adjacent each opening 28 on the cross member 22 is a fixed nut 30 that is fixed to the cross member 22. A down rod 32 is threaded through the fixed nut 30 and downwardly through opening 28 and as seen in FIG. 1. The respective down rods 32 can extend substantially below cross member 22. The lower portion of each down rod, referred to by 32*a*, is designed to be detachably connected to the hold down device that is indicated generally by the numeral 36. Each down rod 32 includes an upper fixed nut 31 secured thereto. The purpose of the upper fixed nut 31 is to function as a stop and to engage the top of cross member 22. This establishes the elevation of the lower end portion 32*a* of the down rod. As will be understood from this disclosure, this effectively establishes the height of the hold down device 36 which in turn establishes the height of the respective voids 34 within the beam structure.

Figure 2:
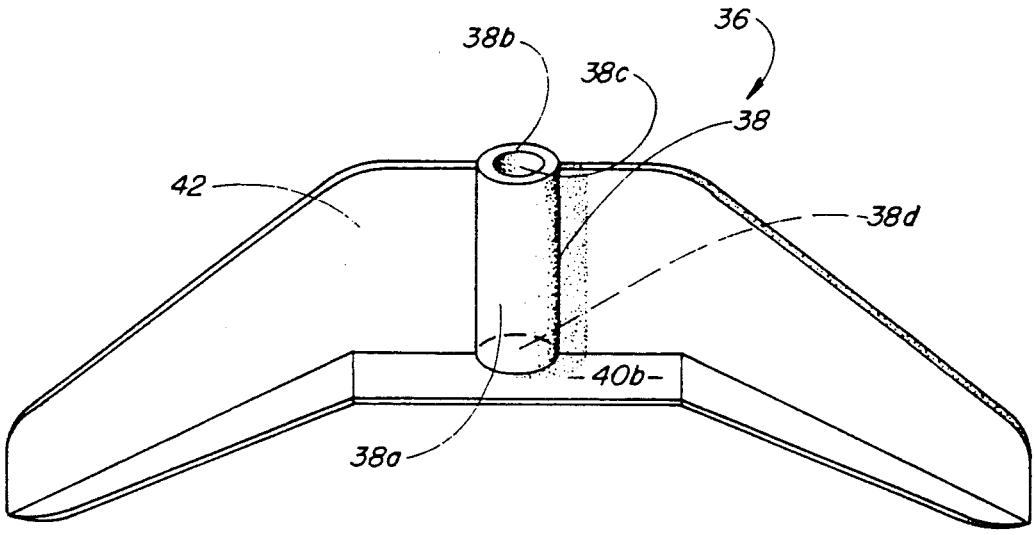
FIG. 2 is a perspective view of the void hold down device of the present invention.
Figure 3:
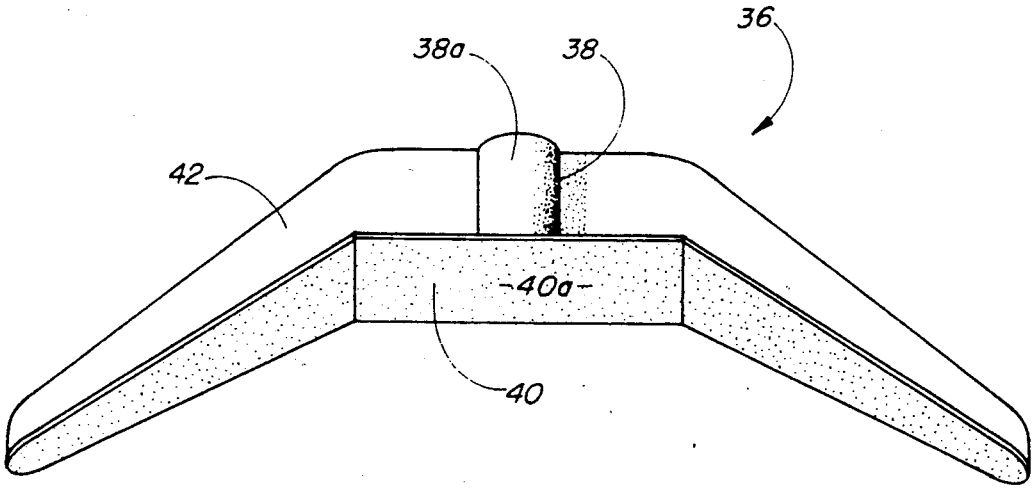
FIG. 3 is a second perspective view, from a different angle, of the void hold down device of the present invention.

Now turning to a more detailed description of the hold down device 36 of the present invention, it is seen (FIGS. 2 and 3) that the same includes an upper central coupling sleeve 38. Sleeve 38 includes a closed outer surrounding wall 38*a* and an open top 38*b*. Internally within coupling sleeve 38 is an inner wall 38*c* that is designed to be frictionally engaged with the lower end 32*a* of a respective down rod 32 extending from the cross member 22. In particular, the coupling sleeve 38 is designed such that the down rod can be frictionally inserted within the coupling sleeve 38 and the coupling sleeve 38 supported from the lower end 32*a* of the down rod 32. The lower end 38*d* of sleeve coupling 38 is closed such that the down rod 32 is not permitted to pass totally through the sleeve coupling 38. In particular, the lower flange 40, to be subsequently discussed, forms a closed bottom for the coupling sleeve 38.

Integrally formed with the coupling sleeve 38 is a lower flange 40. Lower flange 40 includes a bottom flat surface 40*a* and a top flat surface 40*b*. Note that the lower flange 40 defines a concave area underneath the flange and it is this concave receiving area that serves to engage the top portion of a void 34 disposed within the concrete form. As seen in the drawings, the embodiment disclosed herein includes a lower flange that includes three separate angled runs that together form the concave void receiving area.

Finally, the hold down device 36 includes an integrally formed web 42 that is integrally formed with both the lower flange 40 and the coupling sleeve 38. As indicated in the drawings, the web extends from opposite sides of the coupling sleeve to opposite ends of the lower flange 40. It is appreciated from the drawings that web 42 is disposed such that its plane bisects coupling sleeve 38 and that the web is situated about the midpoint of the side edges of the lower flange 40.

The hold down device 36 of the present invention is formed preferably through a molding process and is preferably constructed of a plastic or other similar type of material. It is contemplated that the device can be efficiently made at a relatively low cost through a plastic injection molding process. In any event, the hold down device 36 of the present invention is of a one-piece integral molded construction with the web 42 being merged into both the lower flange 40 and the coupling sleeve 38.

In use, the respective concrete voids 34 are placed in the concrete form as shown in FIG. 1 and a series of longitudinally spaced crossed frame structures 16 are anchored or secured at certain intervals along the concrete form. After or before situating the crossed frame structure over the concrete form, the respective molded void hold down devices 36 are frictionally engaged to the lower end portion 32*a* of the down rods 32. This effectively suspends the void hold down devices 36 over the cardboard or other type voids 34. The voids are lifted and secured to the frame structure 16 by reinforcing tie wire 33 with or without other supports for strategic positioning. It should be pointed out that the down rods 32 essentially establish the vertical height of the voids 34. This is because the down rods include the fixed nut 31 that engages the top of cross member 22 so as to establish the level of the lower end portion 32*a* of each down rod 32. Because the lower end of the sleeve coupling 38 is closed, this means that the void hold down device 36 is positioned at a certain height with respect to the fixed nut 31 and the cross member 22. Once concrete is poured into the concrete form, the voids 34 will tend to float and move as the concrete is vibrated, but the movement of the voids is restricted by the pre-positioned presence of the molded hold down devices 36. Once these hold down devices become fully engaged with the rising voids 34, the vertical movement of the voids 34 is restricted and the voids are appropriately stationed within the concrete form. Note that the general concave shape of the lower flange 44 tends to encompass and confine the respective voids 34 in place within the concrete form. Note that the concave shape of the lower flange tends to confine the voids 34 such that they cannot move laterally outside the confines of the hold down devices 36.

Once the concrete has had sufficient time to cure and hardened, the respective down rods 32 can be easily and conveniently removed from the molded hold down devices 36. By simply screwing the down rods 32 upwardly through the fixed nuts 30 attached to cross member 22 results in the lower end portions 32*a* of the down rods being disengaged from the coupling sleeve 38 of the hold down device 36. This obviously leaves the molded hold down device 36 within the formed concrete beam.

From the foregoing specification and discussion, it is appreciated that the present invention entails a geometrically functional and cost effective void hold down device for use in concrete beam formation. Because the surrounding outer wall 38*a* is closed and because of the nature of the plastic molded material, there is less opportunity for the concrete to itself bond and tie the down rods 32 to the respective hold down devices 36. This obviously contributes to the down rods being easily removable from the coupling sleeve 38 of the hold down device 36. In addition, the geometry of the molded hold down device 36 of the present invention enables the same to be easily installed on the cross frame structures 16 and because of the nature of the design of the present invention, the hold down device 36 can be made in various sizes to accommodate different size voids 34.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A molded plastic void hold down device for use in concrete beams consisting essentially of:

a) a lower transverse flange that includes a downwardly oriented concave face for engaging and restraining a void situated in a concrete beam against upward movement due to the buoyancy of the void, the lower flange includes a generally flat bottom surface and opposite end portions that angle downwardly to form said concave face;

b) a coupling sleeve having a closed surrounding wall and an open top integrally formed with the lower transverse flange and extending upwardly therefrom for frictionally engaging a lower end portion of a down rod to releasably secure the hold down device to the down rod; and c) a web integrally formed with both the coupling sleeve and the lower transverse flange and extending outwardly from opposite sides of the closed surrounding wall of the coupling sleeve and wherein the web merges with both the lower transverse flange and coupling sleeve.

2. The molded plastic void hold down device of claim 1 wherein the lower flange includes a generally flat bottom and top and wherein the web joins the top of the lower transverse flange generally midway between opposite sides of the flange.

3. The molded plastic void hold down device of claim 2 wherein the lower transverse flange includes opposite end portions and wherein the web is solid and extends to the opposite end portions of the lower flange.

4. The molded plastic concrete void hold down device of claim 3 wherein the web is of a thickness less than the diameter of the coupling sleeve and wherein the web is disposed within a plane that generally extends through the center of the coupling sleeve.

5. The molded plastic void hold down device of claim 1 wherein the coupling sleeve includes an inner wall structure for frictionally engaging the lower end portion of the down rod, thereby permitting the down rod to be conveniently removed from the molded plastic void hold down device while the hold down device is anchored within concrete above the void.

6. The plastic void hold down device of claim 3 wherein the coupling sleeve is cylindrical in form and is disposed centrally between the opposite end portions of the lower transverse flange.

7. In a concrete beam forming structure having a concrete beam forming mold and longitudinally spaced upper frame structures mounted above the mold for supporting vertical hold down rods that extend down to and engage void hold down devices, an improved molded void hold down device comprising:

a) a coupling sleeve having an opening formed therein for receiving and releasably connecting to a lower end portion of a down rod;

b) a lower flange integrally molded into the coupling sleeve and extending outwardly from opposite sides of the coupling sleeve to form a hold down surface that engages and holds a void situated in a concrete beam forming structure against upward movement due to the buoyancy of the void; and c) a web integrally molded into both the coupling sleeve and the lower flange and extending outwardly from opposite sides of the coupling sleeve wherein the coupling sleeve, web, and lower flange form a molded integral void hold down device.

8. The beam-forming structure of claim 7 wherein the coupling sleeve includes an inner frictionally fitting wall that is adapted to receive the lower end portion of the down rod such that a frictional fit is formed between the coupling sleeve and the down rod.

9. The beam forming structure of claim 7 wherein the web is of a closed construction and is continuously joined to the lower flange of the molded void hold down device over substantially the entire span of the web.

10. The beam forming structure of claim 7 wherein the lower flange is formed in a generally concave shape so as to define a concrete void receiving area underneath the void hold down device.

11. The beam forming structure of claim 10 wherein the lower flange includes end portions that angle downwardly to form a concave shaped abutting surface.

12. A hold down device for positioning a void in a concrete mold comprising:

(a) a support structure for extending across the top of the mold and having means to secure the support structure to the mold;

(b) a down rod extending downwardly from the support structure into the concrete mold; and (c) a void engaging member releasibly secured to the lower end of the down rod including:

(1) a lower transverse flange having a downwardly oriented concave face for engaging and restraining a void situated in the mold against upward movement due to buoyancy of the void;

(2) a coupling sleeve having a closed surrounding wall and an open top integrally formed with the lower transverse flange and extending upwardly therefrom, said coupling sleeve including an inner surface adapted to frictionally engage the lower end of the down rod to secure the void engaging member to the down rod while permitting the down rod to be removed from the coupling sleeve once the concrete in the concrete mold has set; and (3) a web integrally formed with both the coupling sleeve and the lower transverse flange and extending outwardly from opposite sides of the closed surrounding wall of the coupling sleeve.

* * * * *